US008919159B2

(12) United States Patent
Witte et al.

(10) Patent No.: US 8,919,159 B2
(45) Date of Patent: Dec. 30, 2014

(54) ACTUATOR

(75) Inventors: Martin Witte, Ahaus (DE); Mario Christensen, Mulheim (DE); Erkan Korultay, Hösbach (DE)

(73) Assignee: Huf Hulsbeck & Furst GmbH & Co. KG (DE)

( * ) Notice: Subject to any disclaimer, the term of this patent is extended or adjusted under 35 U.S.C. 154(b) by 759 days.

(21) Appl. No.: 12/445,027

(22) PCT Filed: Oct. 5, 2007

(86) PCT No.: PCT/EP2007/060579

§ 371 (c)(1),
(2), (4) Date: Nov. 3, 2009

(87) PCT Pub. No.: WO2008/043708

PCT Pub. Date: Apr. 17, 2008

(65) Prior Publication Data

US 2010/0064587 A1 Mar. 18, 2010

(30) Foreign Application Priority Data

Oct. 9, 2006 (DE) ..... 10 2006 048 375

(51) Int. Cl.

| | |
|---|---|
| ***E05B 47/00*** | (2006.01) |
| ***E05B 17/00*** | (2006.01) |
| ***E05B 81/78*** | (2014.01) |
| *E05B 77/34* | (2014.01) |

(52) U.S. Cl.

CPC ..... *E05B 17/0004* (2013.01); *E05B 81/78* (2013.01); *E05B 81/77* (2013.01); *E05B 77/34* (2013.01)

USPC ..... 70/257; 70/208; 70/277; 70/278.3; 70/279.1; 292/336.3; 340/5.72

(58) Field of Classification Search

USPC ..... 292/336.3; 70/256, 257, 208, 210, 277, 70/278.2, 278.3, 278.7, 279.1, 280–283, 70/283.1; 340/5.72

See application file for complete search history.

(56) References Cited

U.S. PATENT DOCUMENTS 6,075,294 A * 6/2000 Van den Boom et al. ... 307/10.1
6,218,933 B1 * 4/2001 Josserand et al. ..... 340/426.28

(Continued)

FOREIGN PATENT DOCUMENTS

DE 10153143 10/2001
DE 102004038569 8/2004

(Continued)

OTHER PUBLICATIONS

International Preliminary Report on Patentability (IPRP); International Application No. PCT/EP2007/060579; Filing Date: Oct. 5, 2007.

(Continued)

*Primary Examiner* — Lloyd Gall
(74) *Attorney, Agent, or Firm* — Cantor Colburn LLP

(57) ABSTRACT

The invention relates to an actuator (10) for closing and/or opening a mobile part, especially a door, a tailgate or the like. Said actuator comprises a support (20), an actuating element (30), an electronic unit (50) and a detector system (60), the actuating element (30) being arranged on the support (20), the detector system (60) being arranged in the region of the actuating element (30) and at least a locking or unlocking action being triggerable directly or indirectly on the detector system (60). The electronic unit (50) interacts with the detector system (60) and the electronic unit (50) controls a locking system (40) for locking or unlocking. The invention is characterized in that a receiving unit (70) is integrated into the support (20) and/or into a handle shell (32) in a material fit, at least a part of the electronic unit (50) being permanently accommodated in the receiving unit (70).

21 Claims, 5 Drawing Sheets

(56) References Cited

U.S. PATENT DOCUMENTS

| | | | | |
|---|---|---|---|---|
| 6,698,262 | B2 * | 3/2004 | Wittwer | 70/208 |
| 6,871,887 | B2 * | 3/2005 | Jooss et al. | 292/336.3 |
| 7,210,715 | B2 * | 5/2007 | Kobayashi | 292/336.3 |
| 7,445,257 | B2 * | 11/2008 | Muller et al. | 292/336.3 |
| 7,598,753 | B2 * | 10/2009 | Ieda et al. | 324/658 |
| 7,651,145 | B2 * | 1/2010 | Prokop et al. | 296/37.12 |
| 7,810,856 | B2 * | 10/2010 | Muller et al. | 292/336.3 |
| 7,938,460 | B2 * | 5/2011 | Ishiguro | 292/336.3 |
| 7,984,938 | B2 * | 7/2011 | Tanimoto et al. | 292/336.3 |
| 2003/0122556 | A1 | 7/2003 | Sueyoshi | |
| 2005/0029868 | A1 * | 2/2005 | Monig et al. | 307/10.1 |
| 2007/0182166 | A1 * | 8/2007 | Schindler et al. | 292/336.3 |
| 2008/0018127 | A1 * | 1/2008 | Schindler et al. | 296/1.02 |
| 2010/0237635 | A1 * | 9/2010 | Ieda et al. | 292/336.3 |

FOREIGN PATENT DOCUMENTS

| | | |
|---|---|---|
| DE | 103 48 719 | 5/2005 |
| DE | 112004001103 | 5/2006 |
| DE | 102005046119 | 3/2007 |
| EP | 1 026 348 | 8/2000 |
| EP | 1669520 | 6/2006 |
| FR | 2 772 818 | 6/1999 |
| WO | 99/19585 | 4/1999 |

OTHER PUBLICATIONS

Written Opinion; International Application No. PCT/EP2007/060579; Filing Date: Oct. 5, 2007.

International Search Report; PCT/EP2007/060579; Mar. 3, 2008.

* cited by examiner

ACTUATOR

FIELD OF THE INVENTION

The invention relates to an operating device for opening and/or closing a moving part, in particular a door, a tailgate or the like, having a carrier, operating means, an electronic system and a detector system, such that the operating means are arranged on the carrier. This detector system is arranged in the area of the operating means and at least one locking or unlocking operation can be triggered either directly or indirectly on the detector system. The electronic system cooperates with the detector system and controls a lock system for the locking or unlocking operation.

BACKGROUND OF THE INVENTION

Such operating devices are familiar to those skilled in the art, e.g., from automotive engineering. The patent DE 101 53 143 C1 discloses an operating device used on the side doors of motor vehicles. The operating device here has operating means with which a door on a motor vehicle can be opened or closed. In addition, a detector system that responds to proximity of the human hand is integrated into the operating means. In the event of response, functions such as unlocking of the door lock that are defined by the detector system are triggered in the motor vehicle. The electronic system required for these functions is integrated into an additional housing, which is attached to the rear side of the operating device. This separate mounting and support of the electronic system on the operating device has proven to be complicated and cost intensive.

Based on the aforementioned prior art, the present invention develops an operating device which will avoid the aforementioned disadvantages while using only a few parts.

BRIEF DESCRIPTION OF THE INVENTION

According to the present invention, it is provided that the receptacle means are integrated into or onto the carrier and/or into or onto a handle shell in an integrally bonded manner and at least a portion of the electronic system is permanently supported in the receptacle means. Due to the integrally bonded arrangement of the receptacle means on the operating device, an accommodating space for the electronic system is created, where the electronic system can be stored so that it is protected from external influence. In addition, the integrally bonded integration of the receptacle part into the operating device is accomplished easily and inexpensively. In general, it is advisable to design the carrier and/or the handle shell and the receptacle means to be of the same material and to manufacture them in one manufacturing step.

A bond in which the bonding partners are held together by atomic or molecular forces is considered to be an integrally bonded connection in the sense of the present invention. The integrally bonded connection is an inseparable bond which can be released only by destruction of one of the two bonding partners. An integrally bonded connection of the receptacle part to the carrier by adhesive gluing, welding, laser welding, friction welding and/or soldering is possible.

A module which can serve to open as well as to close a moving part, e.g., a door, and also for locking and unlocking a lock system may be considered as the operating device in the sense of the present invention. The term "operating device" includes in particular exterior door handles and trunk lid handles on motor vehicles. Such operating devices are recessed in the exterior surfaces of the vehicle body and are accessible from the outside for functional operation. Any mechanical systems and electronic components will be arranged largely in the interior of the vehicle body and are thereby protected from direct exposure to environmental influences.

The actual opening operation of the moving part takes place after unlocking the lock system. To do so, the user may make use of operating means, which can be understood to refer to a module that allows the moving part, in particular the door, to be opened and/or closed. It is essentially conceivable for the operating means of the operating device to be designed to be movable and/or immovable. In older vehicles, it is known that by moving the operating means, the lock striker plate of a mechanical lock is transferred from the closed position to an open position. Modern operating device, however, have operating means that no longer need be moved because there is an electric and/or electromechanical adjustment of the lock. To this end, the detector system of the operating device may adjust the respective electromechanical lock on contact with the operating means. Then simply pulling on the operating means is all that is required, e.g., to open the door or the trunk lid.

The term "detector system" is understood to include all units which monitor the environment of the operating device. In particular, this refers to inductive and/or capacitive sensors which may be used for triggering the locking or unlocking operation. The detector system may thus comprise elements that detect the proximity of or contact with the human hand. Information obtained in this way is analyzed in an electronic system and/or processed further. The term "electronic system" comprises all electrically operable elements which are used for analyzing the signals and information of the detector system. The detector system may likewise also be used for transmitting a wake-up signal and/or an identification signal.

The term "lock system" comprises not only the mechanical components used for locking and unlocking moving parts such as doors, but instead it also comprises all electromechanical systems that trigger mechanical components. In addition, the term "lock system" also includes the central lock system used in modern vehicles. This allows complete locking and unlocking of all movable doors and tailgates of a motor vehicle by operating a locking cylinder and/or an electronic signal generator. Such lock systems may be so-called passive or active keyless entry systems.

The inventive carrier has a frame element and a handle shell. Depending on the intended purpose, the frame element and the handle shell may be designed in one piece and together may form the carrier. The carrier may optionally have a separate frame element in which the independent handle shell is supported. In a first advantageous design variant, the receiving shell is designed in one piece and/or is made of the same material arranged on the rear side of the carrier and/or the handle shell. The carrier and/or the handle shell and the receiving element form a space that is closed longitudinally and at the bottom. According to the invention, the electronic system is permanently stored in the space where it is protected from external influences. To optimize this protection, the receptacle means may have a housing element and a cover element. This combination results in a space completely surrounding the electronic system into which no environmental influences can penetrate from the outside.

For further protection of the electronic system, it may be cast with a casting compound in the receptacle means. Casting compounds comprising a single component resin, a multicomponent resin or a synthetic resin have been found to be advantageous here. In particular polyester resins, polyurethane resins, epoxy resins and/or silicone resins offer both good electric insulation as well as permanent protection against external influences. To prevent an electronic system embedded in a casting compound from falling out of the receptacle means, a groove may be provided in the interior of said receptacle means. The casting compound flows into this groove in casting and thus forms a form-fitting and non-positive bond to the receptacle means. Instead of a groove, it is also conceivable to provide a bulge which forms a form-fitting connection with the casting compound. This ensures that the electronic system will be held and/or supported securely in the receptacle means by the casting compound even in the presence of extreme vibration and shaking.

It has proven expedient if the receptacle means, in particular the housing element, are welded onto the carrier. To this end, the two aforementioned components may be made of plastic. In one conceivable embodiment of the invention, the receptacle means may be attached to the side of the carrier facing the interior by laser welding. For example, the receptacle means may be designed to be laser transparent so that the surface of the carrier absorbs the laser. In particular, the surface may be coated with a certain material so that the carrier becomes the absorbent medium. Laser welding may then be performed under a protective gas atmosphere in one possible embodiment. Other alternative joining methods are also conceivable, e.g., by ultrasonic welding or by adhesive gluing of the receptacle means to the carrier. The adhesive material used may be selected from all suitable adhesives. In a contrary exemplary embodiment, it is conceivable for the receptacle means to be manufactured simultaneously with the carrier in one manufacturing step, so that the two parts are designed in one piece and of the same material.

In another design variant, the cover element may cover a head side of the housing element in at least some areas. To protect the electronic system from environmental influences such as moisture, etc., it has proven advantageous if the cover element completely covers the housing element and in particular is sealed with respect to the outside. In addition, seals may be incorporated into the cover element, leading to sealing of the receptacle means in a manner that is protected from splash water. It is also conceivable for an inspection window to be inserted into the cover element, through which monitoring of the electronic system and/or the casting compound is possible.

In another advantageous embodiment, the cover element may have at least one rod-type blocking means. This blocking means may be arranged on the underside of the cover element and may protrude into the casting compound. If the cover element is placed on the housing element immediately following the casting of the electronic system, the blocking means may penetrate into the casting compound while still soft. After curing of the casting compound, the result is a non-positive and/or form-fitting bond between the blocking means and the casting compound so that the cover element is held securely on the housing element. In another design variant, the housing element has at least one restraining means and the cover element has blocking means, such that the restraining element and the blocking means form a reversibly releasable connection. In particular the restraining means may be catch means, the blocking means may be mating catch means, and the catch means may be arranged in the head area of the receptacle means. The mating catch means require only a very small design space and restrict the interior of the receptacle means to an insignificant extent. In addition, the kinematics of the catch means and/or mating catch means may be reversed, and the restraining means may have the mating catch means with which the catch means arranged on the blocking means engage. Optionally the cover element may also be welded to the housing element so that it is inseparably attached. The core of this exemplary embodiment is protection of the interior space of the receptacle means from external influences. To achieve this, the housing element and the cover element must be joined together as tightly as possible.

To be able to easily install and securely restrain the electronic system in the receptacle means, the receptacle means may have positioning means. The positioning means serve to hold the electronic system in a defined position within the receptacle means. Use of the positioning means also makes it possible for the electronic system to be arranged centrally in the receptacle means, so that the casting compound which is optionally used can completely surround the electronic components. In general, the electronic system is arranged on a circuit board, so it has proven advantageous if the positioning means cooperate with the circuit board in such a way that the latter is reversibly connectable to the positioning means. It has thus proven expedient if the positioning means are designed as a type of snap lock or clamp into which the circuit board can be inserted. In one conceivable embodiment, the positioning element may be connected to the receptacle means in one piece and/or made of a uniform material. This is advantageous in particular when the receptacle means are made of a plastic and the positioning means can be brought into a corresponding form by drawing, casting and/or pressing. At the same time, the positioning means may also have electric contacts so that an electric connection can be established to the circuit board and/or to the electronic system on the circuit board.

To communicate with the detector system, the electronic system in general has a number of cables emerging from the receptacle means. To be able to guarantee an unambiguous position of the cables even in large-scale industrial production of the operating device, the electronic system and/or the circuit board may have at least one characteristic element. This characteristic element cooperates with the positioning means and ensures a defined arrangement of the electronic system and/or the circuit board within the receptacle means. The characteristic element may be a recess, catch means, a borehole and/or a structure. For the complementary positioning means, the following have proven advantageous: a nose, mating catch means, a pin and/or a mating structure opposite the given structure. The cooperation of the characteristic element and the positioning means ensures that the electronic system can be introduced into the receptacle means only in a predefined type and manner. Attempts to insert the electronic system into the receptacle means in a position other than the intended position are thus prevented. It has proven advantageous if the positioning means are made of a plastic having a lower hardness than the circuit board. This ensures that on insertion of the circuit board into the positioning means, there cannot be any damage to the circuit board. It is also conceivable that the aforementioned characteristic element of the circuit board may be provided with electric contacts which enter into an electric connection with the contacts on the positioning means. Thus the electric connecting cables, for example, may be arranged directly on the contacts of the positioning means to connect the electronic system electrically to the other vehicle electric and/or electronic system on installation. Consequently, additional connecting cables on the circuit board and their electronic system may be omitted.

In another advantageous embodiment of the inventive operating device, the receptacle means may have a rod-type bearing element. The bearing element may be arranged in the area of the operating means and/or the carrier. The bearing element serves in particular as a bearing for the detector system or individual elements of the detector system. As already described above, the locking or unlocking of the lock system is often triggered by contact with the operating means. To position the detector system in the vicinity of the operating means, it has proven advantageous to use a finger-type bearing element which is arranged perpendicular to the carrier plane and protrudes in the direction of the operating means. In one conceivable embodiment, the bearing element and the housing element may be connected in one piece and/or may be made of the same material. This reduces the cost in manufacturing the operating device and allows a uniform casting of the receptacle means and the bearing element with casting compound.

The inventive operating device may optionally have an antenna arranged in the receptacle means, in particular on the circuit board and/or in the bearing element. The antenna serves as part of a sending and receiving unit for regulating access to the motor vehicle. For example, the user may carry an electronic signal generator on him, by means of which authentication with respect to the vehicle is possible. To this end, the signal generator, also known as an ID generator, sends coded information. The vehicle receives and compares this information with stored data. In the event of a positive evaluation of the received information, the lock system may lock or unlock the doors of the vehicle. In modern vehicles, not only is there often a one-time transmission of information but instead there is often multilayer bidirectional communication between the electronic signal generator and the motor vehicle. To convey the information, electromagnetic waves are generally used as the carrier system. To receive and/or to send these electromagnetic waves, a sending and receiving unit having an antenna is integrated into the vehicle. It has proven advantageous for this antenna to be arranged in the receptacle means, in particular on the circuit board.

In another advantageous embodiment, the receptacle means and/or individual elements of the receptacle means contain a plastic, a metal and/or a composite material. The term "plastic" is understood to refer to all substances in which synthetic polymers, i.e., semisynthetically created polymers with organic groups, are the basic component. In contrast with that the term composite material is understood to include all materials comprising two or more materials bonded together. In addition, the receptacle means and/or individual elements of the receptacle means can be manufactured by injection molding, extrusion, blow molding and/or injection blow molding.

Furthermore, the invention is directed to a motor vehicle having at least one operating device.

BRIEF DESCRIPTION OF THE FIGURES

Additional measures, features, details and effects of the invention are derived from the dependent claims, the following description and the drawings. The invention is diagrammed schematically in several exemplary embodiments in the drawings, in which

DETAILED DESCRIPTION OF THE INVENTION

Figure 1:
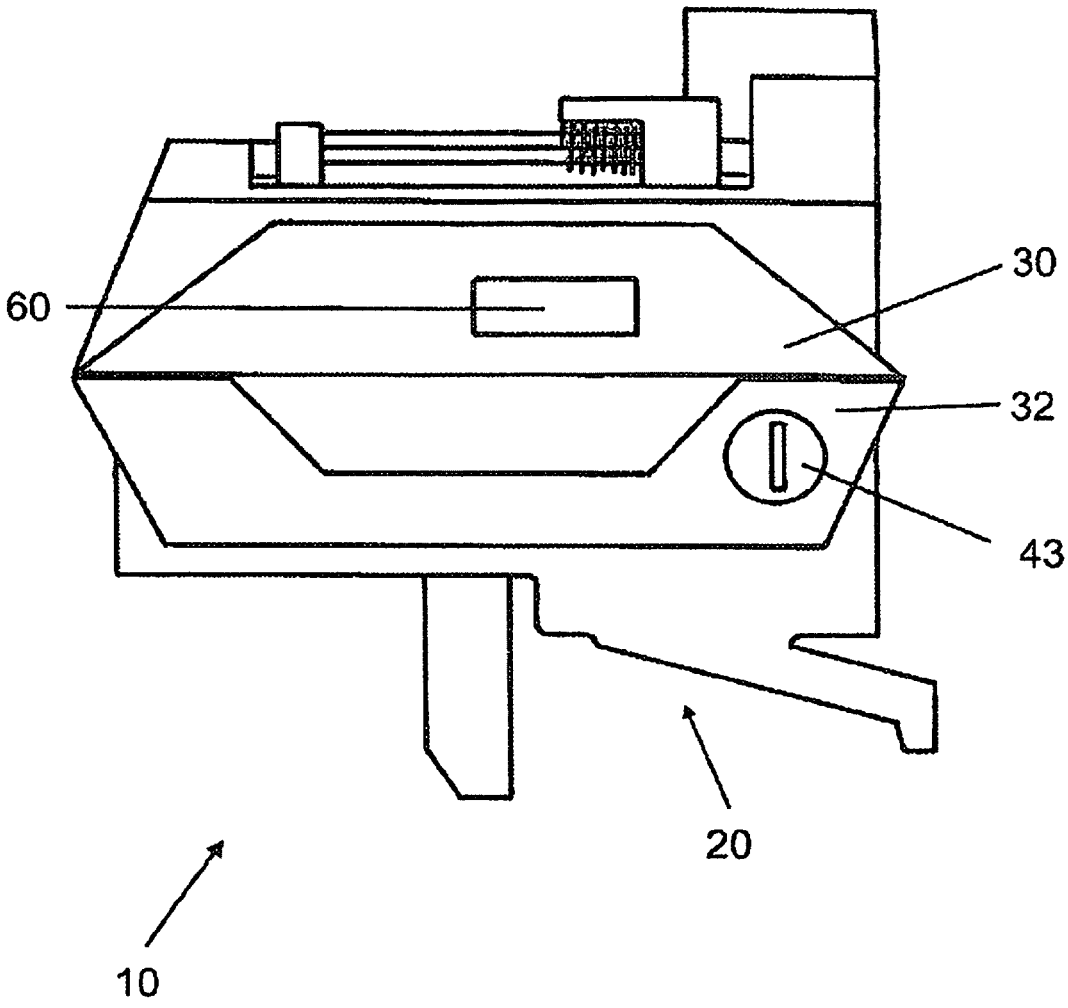
FIG. 1 shows a schematic diagram of a front view of an inventive operating device.

FIG. 1 shows a front view of an inventive operating device 10. In the exemplary embodiment shown here, the operating device 10 is an exterior door handle. Such operating devices 10 are mounted in the exterior surfaces of the vehicle body of vehicles (not shown in the figures). By operating the operating means 30, it is possible to open and/or close a movable door. Essentially only the operating means 30 and a handle shell 32 of the operating device 10 are accessible from the outside, i.e., from the exterior side of the door. The other elements of the operating device 10 face the interior side of the door. A lock cylinder 43 of a lock system 40 is countersunk in the handle shell 32. The mechanical locking or unlocking of the lock system 40 can be triggered on the lock cylinder 43, thereby making it possible to ensure that unauthorized persons cannot gain access to the motor vehicle. In addition to the lock cylinder 43 shown here, the locking and/or unlocking operation may also be controlled electrically by a passive or active keyless entry system. The operating means 30 illustrated in the figures include a tailgate handle. The operating means 30 may also be designed as a pull handle, a revolver handle or the like, such that a detector system 60 is expediently provided in or on the operating means 30.

Figure 2:
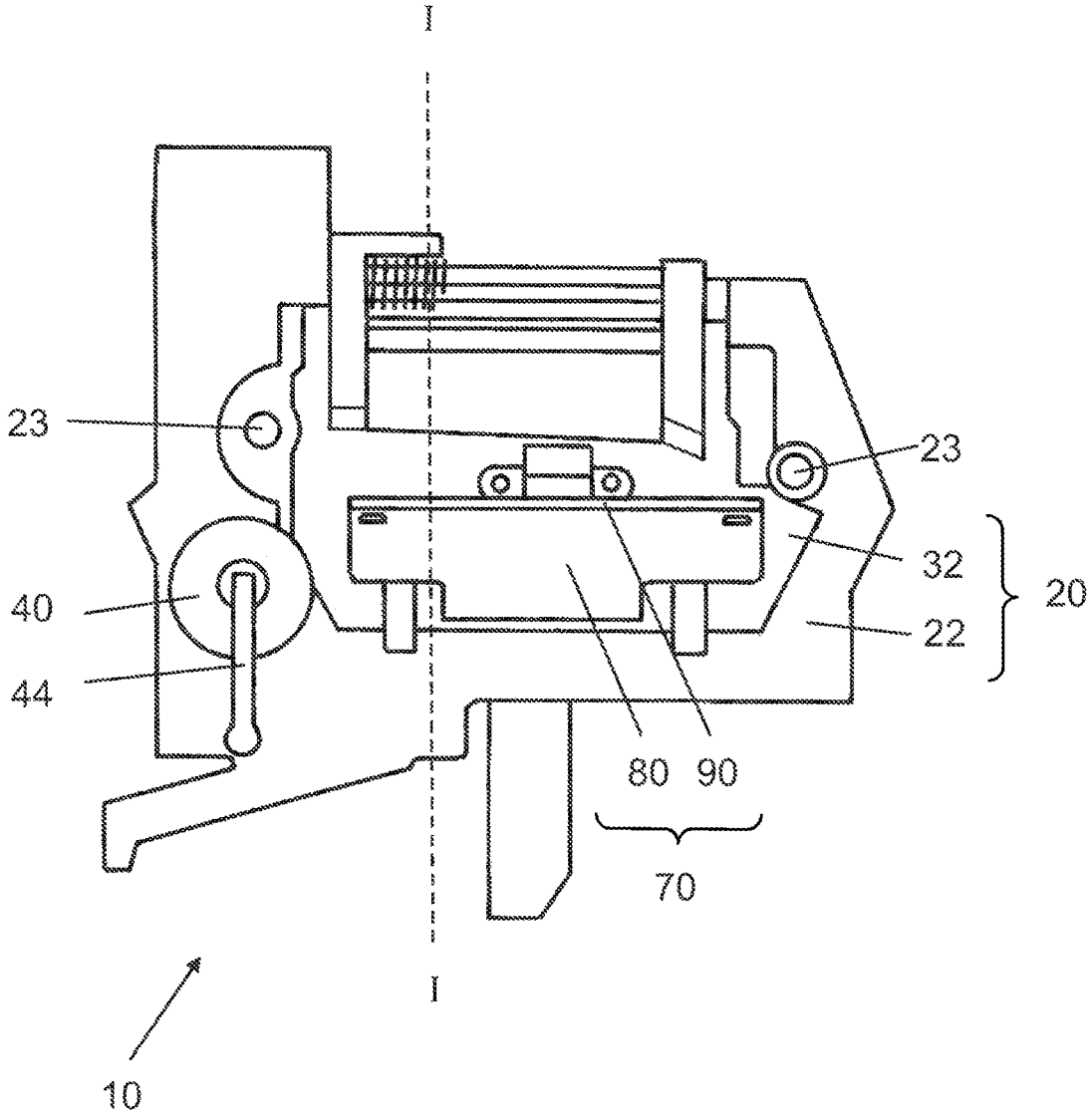
FIG. 2 shows a rear side of the operating device having a receptacle means.

FIG. 2 shows the rear side of the operating device 10 from FIG. 1. The discernible elements of the operating device 10 are arranged on the inside of the body of the moving part. The basis for the operating device 10 is formed by a carrier 20, which is supported in the inside of the door and on which the operating means 30 and the lock system 40 are arranged. In the exemplary embodiment shown here, the carrier 20 is designed in two parts. First, the carrier 20 has a frame element 22, which is designed in the form of a rectangle and can be mounted on the vehicle body by means of a receptacle means 23. Second, the carrier 20 has a handle shell 32, which is supported in the frame element 22. The handle shell may, but need not, be connected in one piece to the frame element 22 and/or made of the same material as the latter.

FIG. 2 shows the rear side of the lock cylinder 43 with transmitting means 44 arranged thereon. By way of the transmitting means 44, the rotational movement introduced into the lock cylinder 43 by using a key can be transmitted to a lock striker plate (not shown), which leads to the locking or unlocking operation.

As shown in FIG. 1, the operating means 30 support the detector system 60. This may involve a capacitive and/or inductive sensor, which detects proximity of and/or contact with the operating means 30 by a human hand. In the case of a passive keyless entry system, the lock system 40 is triggered for the locking or unlocking operation by detection of a human hand in the vicinity of the operating means 30. To perform these functions, an electronic system 50 is required which cooperates with the detector system 60. According to the invention, it is provided that a receptacle part 70 is integrated into or onto the carrier 20 or more specifically into or onto the handle shell 32 in a physically bonded manner and at least part of the electronic system 50 is permanently supported in the receptacle means 70. The receptacle means 70 are advantageously integrally connected to the carrier 20 or more specifically the handle shell 32 and/or made of the same material. In the exemplary embodiment illustrated in FIG. 2, the receptacle means 70 are integrated into the handle shell 32 and have a housing element 80 and a cover element 90. The two elements 80, 90 together with the handle shell 32 form a closed space in which the electronic system 50 is supported in such a way that it is protected from external influences. In addition, the electronic system 50 may be cast with a casting compound 110 in the receptacle means 70. It has been found to be advantageous if the casting compound 110 is made of a resin or synthetic resin.

Figure 3:
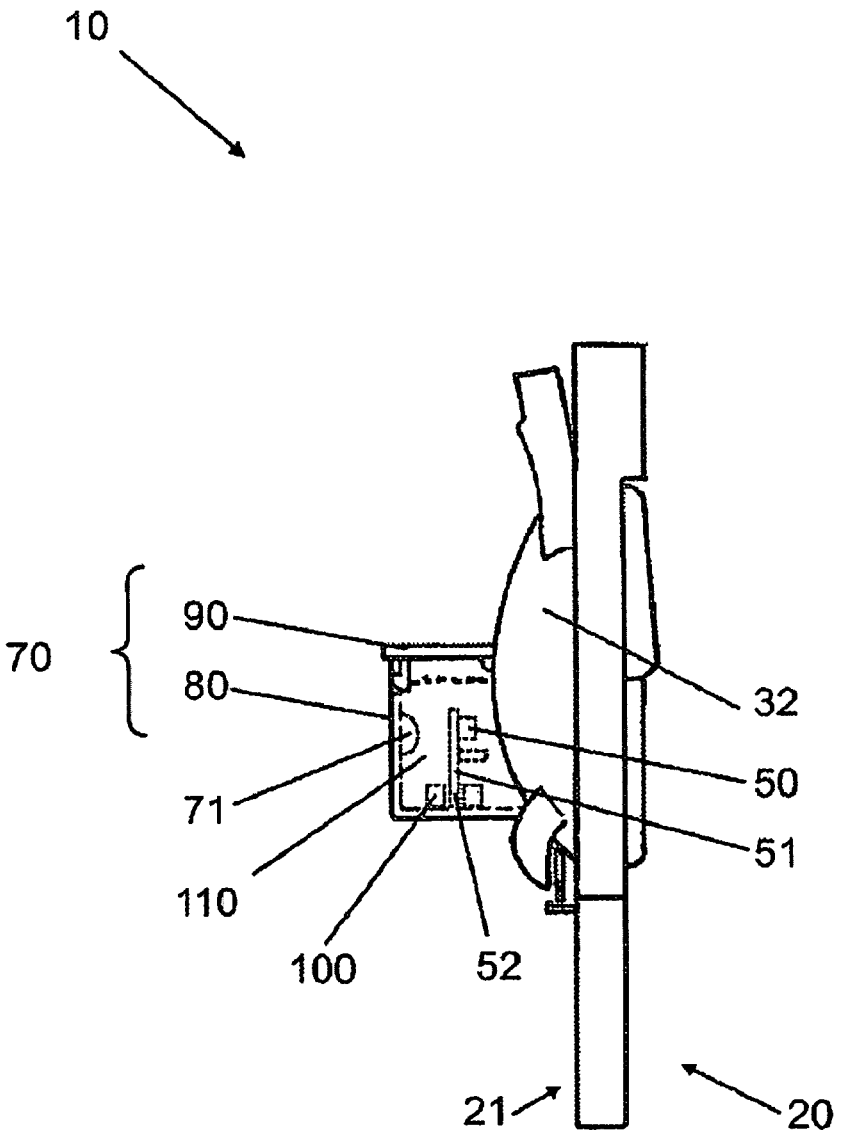
FIG. 3 shows a side view of the operating device having the receptacle means.

FIG. 3 shows a cross section through the inventive operating device 10 from FIG. 2 along sectional line I-I. In the exemplary embodiment shown here, the housing element 80 has an L-shaped cross section and is integrated into the handle shell 32 with one free end of a longitudinal side on the bottom and on a rear side 21 of the handle shell 32. In this way, a space that is completely closed by the cover element 90 placed on it from above and can hold the electronic system 50 permanently in its interior is formed on the rear side of the handle shell 32, said space being closed on the bottom and on the longitudinal sides. Likewise, the space of the receptacle part 70 may also be opened on the side, i.e., on the side opposite the rear side 21, so that the cover element 90 seals the space on the left side in this case.

In modern operating devices 10, the electronic system 50 is generally arranged on a circuit board 51. To achieve a simple and secure installation of the circuit board 51 in the receptacle means 70, positioning means 100 may be introduced into the receptacle means 70. For example, a receptacle for the circuit board 51 is illustrated in FIG. 3. However, the positioning means 100 may also be catch means such as a snap lock or a clamp which cooperates in a non-positive and/or force-fitting manner with the circuit board 51. In another embodiment, the circuit board 51 may have a characteristic element 52 which cooperates with the positioning means 100. The characteristic element 52 ensures that the electronic system 50 and/or the circuit board 51 can be plugged into the receptacle means 70 in only one position. As already mentioned previously, an electric connection may also be established via the positioning means 100 and the characteristic element 52.

Figure 4:
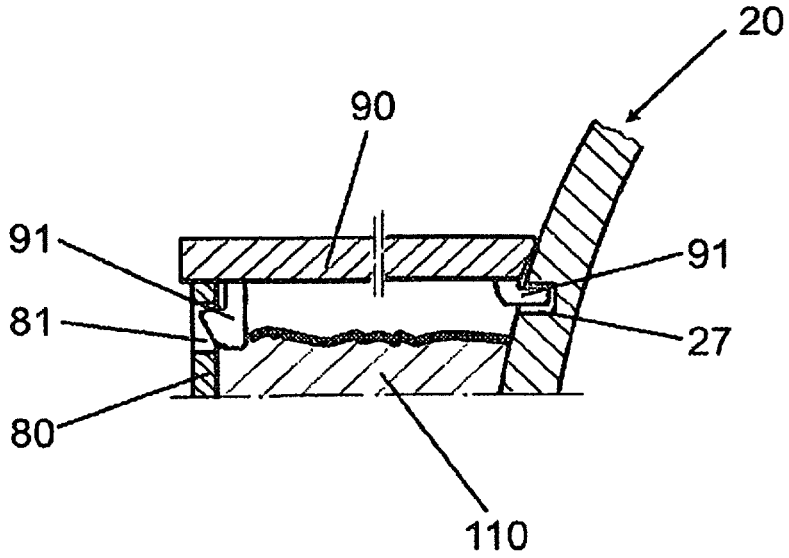
FIG. 4 shows an enlarged section of the operating device from FIG. 3.

For insulation and protection against external influences, the receptacle means 70 in FIG. 3 are filled with a casting compound 110. To be sure that the entire electronic system 50 and/or the entire circuit board 51 is/are surrounded by the casting compound 110, the receptacle means 70 should be completely filled. To allow a good hold for the casting compound 110 in the receptacle means 70, optionally a groove and/or a bulge 71 may be provided in the interior of the housing element 80. In addition, the housing element 80 may be closed by the cover element 90, which is illustrated in FIG. 4 which shows an enlargement of a detail from FIG. 3. A head area of the housing element 80 with the cover element 90 is shown. As this shows, the cover element 90 protects the casting compound 110 from possible contact with other objects. To allow a reversibly detachable connection between the housing element 80 and the cover element 90, the latter has two blocking means 91. In the exemplary embodiment shown here, the first blocking means 91 are designed with a hook shape engaging in the receptacle 27 in the wall 20. The second blocking means 91 have the function of catch means and cooperate with the restraining means 81 designed as a borehole. If a cover element 90 that is reversibly releasable by the housing element 80 is not desired, at least one of the blocking means 91 shown here may be designed to be large, so that it protrudes into the casting compound 110. After hardening of the casting compound 110, a non-positive and/or force-fitting connection to the blocking means 91 is formed. It has proven to be advantageous if the blocking means 91 are pin shaped and have a hook-shaped contact face on the outer surface running radially because the casting compound 110 can flow between these contact faces, thereby embedding a large surface area in a non-positive and/or form-fitting manner.

Figure 5:
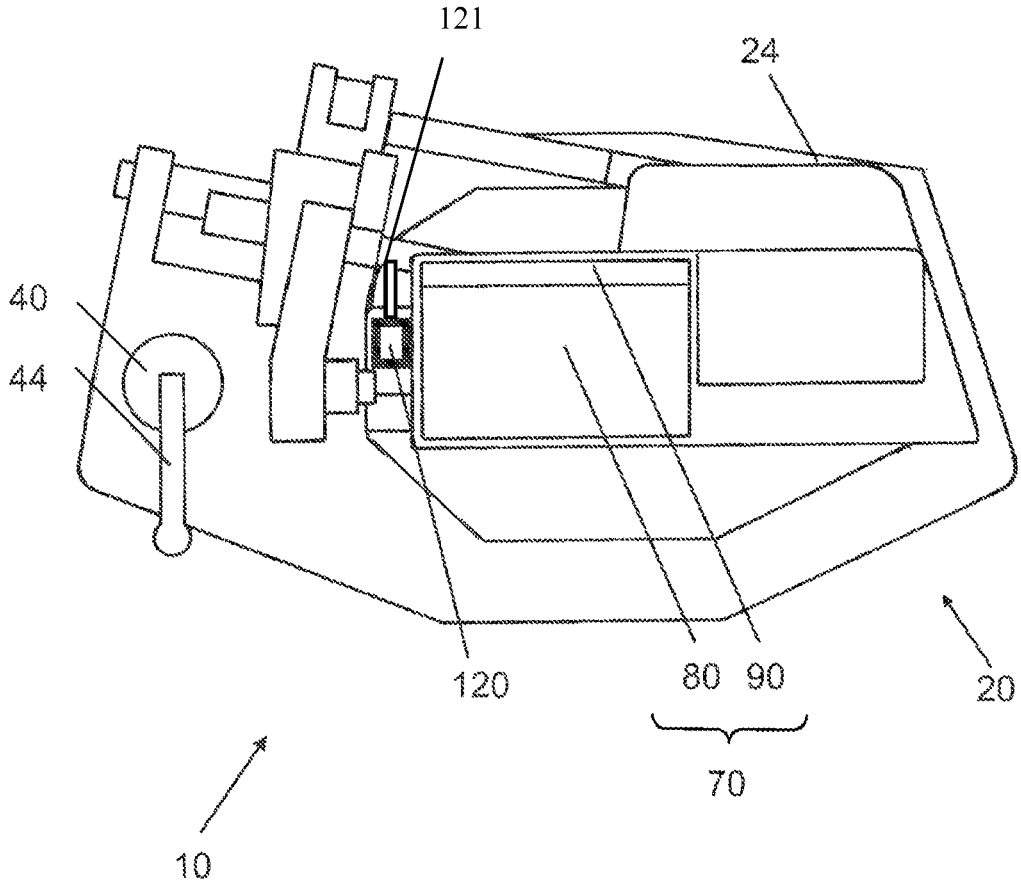
FIG. 5 shows another design variant of the inventive operating device.

FIG. 5 shows another embodiment of the inventive operating device 10. In contrast with the first exemplary embodiment, the carrier 20 has a frame element which completely covers the handle shell 32 (not visible in the drawing). For reinforcement, the frame element 22 has one or more rib-like structures 24. The inventive receptacle means 70 are supported between these structures 24. As also disclosed in the exemplary embodiment described above, the receptacle element 70 has a housing element 80 and a cover element 90. In addition, a rod-like bearing element 120 is mounted on one of the transverse sides of the receptacle means 70. This bearing element 120 is connected in one piece to the receptacle means 70 and is made of the same material. The function of the bearing element 120 consists of supporting some or all of the elements of the detector system 60. The inventive operating device may optionally have an antenna 121 arranged in the receptacle means 70, in particular on the circuit board and/or in the bearing element 120. In addition to the arrangement illustrated in FIG. 1, the detector system 60 may also be arranged at the height of the lock cylinder 43 in the operating device 10. To achieve a suitable positioning, rod-shaped bearing elements 120 have proven advantageous, protruding away from the carrier 20 in the direction of the operating means 30. Through the inventive one piece combination of the bearing element 120 and the receptacle element 70 which are made of the same material, a uniform casting with the casting compound 110 can be achieved. Thus no interspace through which moisture can penetrate is formed between the bearing element 120 that receives the detector system 60 and the receptacle means 70 restraining the electronic system 50.

The invention claimed is:

1. An operating device for at least one of opening and closing a moving part, the operating device comprising: a carrier, operating means, an electronic system, a lock system and a detector system, wherein the operating means are arranged on the carrier, the operating means support the detector system, and at least one locking or unlocking operation of the moving part via the lock system can be triggered on the detector system, the electronic system cooperates with the detector system and the electronic system triggers the lock system, wherein a housing element of a receptacle and the carrier are inseparably bonded and only released by at least one of the housing element and the carrier being destroyed, such that at least one part of the electronic system is permanently supported in the receptacle wherein the carrier is arrangeable on an interior side of the moving part, and wherein the carrier and the housing element form a space that is closed on the bottom and the longitudinal sides, the carrier forming one wall of the space.

2. The operating device according to claim 1, wherein the receptacle has a cover element attached to the housing element.

3. The operating device according to claim 1, wherein the housing element of the receptacle is made of a same material as the carrier such that the receptacle is arranged on at least one rear side of the carrier.

4. The operating device according to claim 1, wherein the electronic system is casted with a casting compound in the receptacle, such that the casting compound is at least one of a single-component resin, a multi-component resin and a synthetic resin.

5. The operating device according to claim 4, wherein the receptacle has at least one of a groove and a bulge so that a form-fitting connection is formed between the receptacle and the casting compound.

6. The operating device according to claim 2, wherein the cover element covers a top side of the housing element, whereby the cover element seals the receptacle in such a way that at least one of the electronic system and a casting compound is/are protected from external influences.

7. The operating device according to claim 2, wherein the housing element has at least one restraining means, and the cover element has at least one blocking means, and the restraining means and the blocking means form a reversibly releasable connection, such that the restraining means comprise a catch, the blocking means comprise a mating catch, and the catch is arranged in a top area of the receptacle.

8. The operating device according to claim 7, wherein the blocking means are shaped like a pin and arranged on a bottom side of the cover element and protrude into a casting compound.

9. The operating device according to claim 1, wherein the receptacle has at least one positioning means, such that the positioning serve to at least one of holding and positioning the electronic system in the receptacle means.

10. The operating device according to claim 9, wherein the positioning means are connected in at least one of the following ways: in one piece to the receptacle or made of the same material as the receptacle, wherein a part of the housing element forms the positioning means.

11. The operating device according to claim 9, wherein the electronic system is arranged on a circuit board and the circuit board is reversibly detachably connectable to the positioning means, such that the circuit board can be inserted into the positioning means.

12. The operating device according to claim 11, wherein at least one of the electronic system and the circuit board has at least one characteristic element which cooperates with the positioning means and ensures a distinct positioning of at least one of the electronic system and the circuit board within the receptacle.

13. The operating device according to claim 12, wherein the characteristic element is chosen from the group comprising a recess, a catch, a borehole and a structure, such that the positioning means comprise at least one of a nose, a mating catch, a pin and a mating structure complementary to said structure.

14. The operating device according to claim 1, wherein the lock system has a lock cylinder and a transfer element such that a mechanical locking or unlocking operation can be triggered.

15. The operating device according to claim 1, wherein the receptacle has a rod-type bearing element and the bearing element is arranged on the carrier, such that the housing element is at least one of connected in one piece with the bearing element and of the same material with the bearing element.

16. The operating device according to claim 15, wherein the bearing element supports individual elements of the detector system which trigger locking of the lock system, such that the detector system triggers locking of the moving part in the bearing element.

17. The operating device according to claim 1, wherein at least one of the receptacle and individual elements of the receptacle contain at least one of a plastic, a metal and a composite material.

18. The operating device according to claim 1, wherein at least one of the receptacle and individual elements of the receptacle are manufactured by at least one of injection pressing, injection molding, blow molding and injection blow molding.

19. The operating device according to claim 1, wherein an antenna is provided on at least one of a circuit board, in the receptacle and in a bearing element, such that the antenna is part of a sending and transmitting unit.

20. A motor vehicle having an operating device according to claim 1.

21. The operating device according to claim 1, wherein the carrier further comprises a handle shell and the housing element being inseparably bonded and only released by at least one of the housing element and the handle shell being destroyed.

* * * * *

UNITED STATES PATENT AND TRADEMARK OFFICE

CERTIFICATE OF CORRECTION

PATENT NO. : 8,919,159 B2
APPLICATION NO. : 12/445027
DATED : December 30, 2014
INVENTOR(S) : Martin Witte et al.

It is certified that error appears in the above-identified patent and that said Letters Patent is hereby corrected as shown below:

In the Claims

Column (9), lines 21-24,

Please replace claim 9 with the following:

9. The operating device according to Claim 1, wherein the receptacle has at least one positioning means, such that the positioning means serve to at least one of holding and positioning the electronic system in the receptacle.

Signed and Sealed this
Twelfth Day of May, 2015

Michelle K. Lee

Michelle K. Lee
*Director of the United States Patent and Trademark Office*